United States Patent [19]

Bell et al.

[11] Patent Number: 4,906,211

[45] Date of Patent: Mar. 6, 1990

[54] CONNECTOR FOR AIRCRAFT-TO-GROUND MAINTENANCE ELECTRICAL CONNECTION

[75] Inventors: Robert Bell, Hawthorne; Douglas Chase, Redondo Beach; Henry Fernandez, Torrance, all of Calif.

[73] Assignee: Wyle Laboratories, El Segundo, Calif.

[21] Appl. No.: 8,826

[22] Filed: Jan. 30, 1987

[51] Int. Cl.[4] ..... H01R 13/00

[52] U.S. Cl. ..... 439/851

[58] Field of Search ..... 439/842, 843, 851

[56] References Cited

U.S. PATENT DOCUMENTS

| | | | |
|---|---|---|---|
| 3,453,587 | 7/1969 | Neidecker | 439/843 |
| 4,120,557 | 10/1978 | Horrocks | 439/843 |
| 4,128,293 | 12/1978 | Paoli | 439/843 |

OTHER PUBLICATIONS

"Electrical & Electronic Contacts" by Multilam Corporation.

*Primary Examiner*—Joseph H. McGlynn

*Attorney, Agent, or Firm*—Freilich, Hornbaker, Rosen & Fernandez

[57] ABSTRACT

A socket assembly is provided at the end of a heavy electrical cable which includes sockets designed to be pushed into connection with pins on an aircraft, to pass current between them, which provides low resistance to avoid heating while also providing a high withdrawal force to prevent the weight of the cable end from pulling it out of connection with the aircraft pins. The sockets include pin-receiving holes, with grooves in the hole walls for holding multi-beam contactors. Each contactor includes a pair of spaced circular bands and a plurality of beams extending between the bands and bowed radially inwardly to resiliently contact the pin. A socket includes two of such contactors, whose beams engage the plug at two locations spaced along the hole to more uniformly guide the pin along the hole and provide low contact resistance and a high resistance to withdrawal. The contactors are initially plastically deformed when the pin is first inserted, to assure that a high withdrawal force is achieved.

7 Claims, 1 Drawing Sheet

CONNECTOR FOR AIRCRAFT-TO-GROUND MAINTENANCE ELECTRICAL CONNECTION

BACKGROUND OF THE INVENTION

An airport electrical power supply is coupled to an airliner parked on the ground by a workman who pulls the outer end of a power cable to the airplane. Sockets at the end of the cable are mated with pins near the bottom of the aircraft, by the workman pressing the cable end up against the pins, and relying upon friction to hold the cable end in place. The weight of the cable end portion extending from the ground to the aircraft may be about 15 pounds, and the holding power should be several times as much to assure that an accidental disconnection does not occur, which can result in sparks that can ignite fuel and which can damage the cable end. When a disconnection is desired, a technician turns off the power and then pulls, preferably with a force of about 80 pounds, to disconnect the cable end. The withdrawal force must be high, such as about 80 pounds, but must not be much higher than that or disconnection is very difficult.

Considerable current flows to the aircraft, and a low resistance connection is desirable to avoid the creation of high temperatures at the connection. A low resistance connection system which assured a predictable high unmating force, would be of considerable value.

SUMMARY OF THE INVENTION

In accordance with one embodiment of the present invention, a connection system is provided which includes a socket assembly whch assures a predictable high unmating force between the socket assembly and a pin assembly of the system. The socket assembly includes a socket having a substantially cylindrical hole with an internal groove. At least one, and preferably two, band contactors lie in the internal groove, each contactor including a pair of opposite largely circular bands connected by a plurality of inwardly-bowed beams. A pair of such contactors lie in tandem in the groove, and provide two spaced locations along the socket where a pin is engaged.

The groove can be made shallow and the contactors of relatively thick metal, to provide a large interference fit between the contactors and the pin. The interference can be made so great that the contactors undergo plastic deformation when first engaged by the pin. While the initial withdrawal force is excessive, the plastic deformation after many pin insertions and withdrawals is such that the withdrawal force drops to a desired predictable level.

The novel features of the invention are set forth with particularity in the appended claims. The invention will be best understood from the following description when read in conjunction with the accompanying drawings.

DESCRIPTION OF THE PREFERRED EMBODIMENTS

Figure 1:
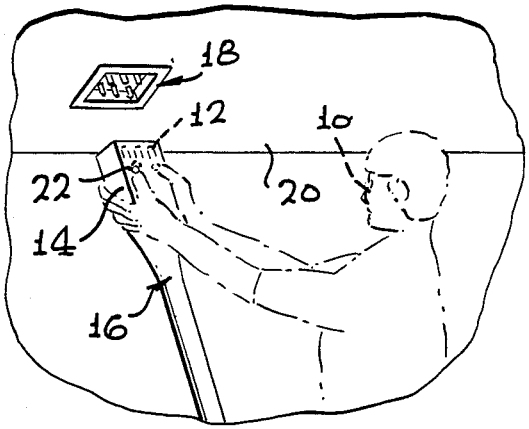
FIG. 1 is a perspective view of a connection system, showing the end of a power cable being connected to terminals on an aircraft.

FIG. 1 illustrates a workman 10 who is disconnecting a socket assembly 12 at the foward end 14 of a power cable 16 from an aircraft pin assembly 18. The pin assembly is locatedon an airliner 20 parked at an airport. In initially connecting the socket and pin assembly, the workman pushes the cable end forcefully against the pin assembly until they are mated. A switch 22 is then depressed to "turn on" the power, and the connection is left without any auxiliary lock to hold the cable end in place. The frictional force resisting pullout of the socket assembly 12 must be great enough to assure that disconnection will not occur despite vibrations and the like that are encountered. A disconnection of a "hot" cable from the pins on an aircraft can lead to an open spark which could ignite fuel vapors that are commonly found in the area. An auxiliary lock is commonly no used because there is a high possibility that workman will not use them.

Figure 2:
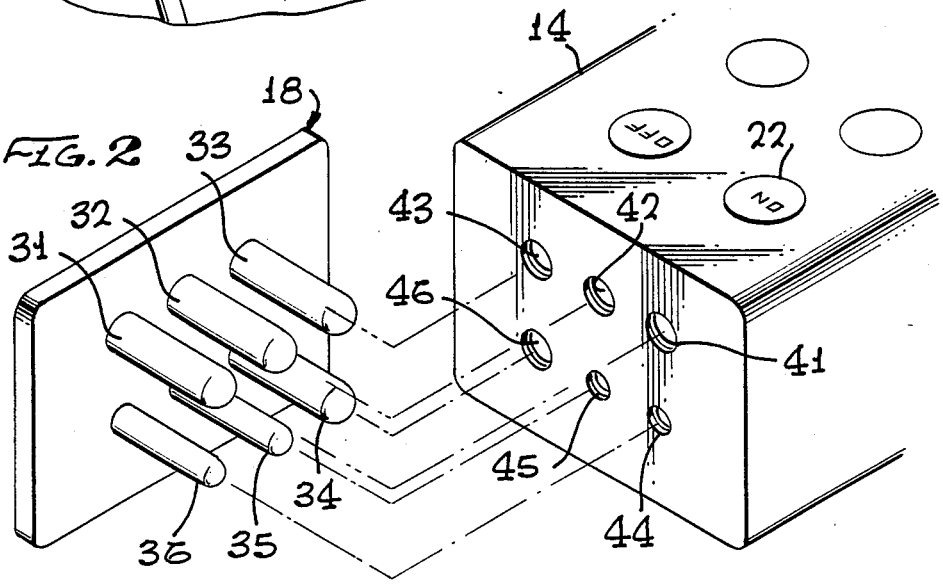
FIG. 2 is a partial perspective view of the cable end and pin arrangement of FIG. 1.

FIG. 2 illustrates a common connection system wherein the pin assembly 18 includes four large pins 31–34 that carry considerable current, and two small pins 35, 36. The socket assembly includes corresponding sockets 41–46. Considerable current may pass between the large pins and sockets, so a large area of contact is required to minimize contact resistance and consequent heating.

Figure 4:
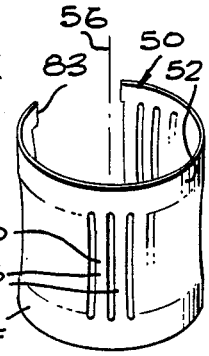
FIG. 4 is a perspective view of a contactor of the socket of FIG. 3, prior to installation of the contactor into the receptacle.

One type of low resistance socket contact is a lam or multi-beam contactor of the type illustrated at 50 in FIG. 4. This contactor includes a pair of spaced substantially circular bands 52, 54 lying on an axis 56, and numerous beams 58 connecting the opposite bands. The beams are inwardly bowed, towards the axis 56, so that the middle 60 of each of the beams can bear against a pin. Such contactors have been developed as contacts that require low insertion and withdrawal forces while providing low contact resistance. The low contact resistance is highly desirable in the present aircraft connection system, but the low withdrawal force is highly undesirable.

Figure 3:
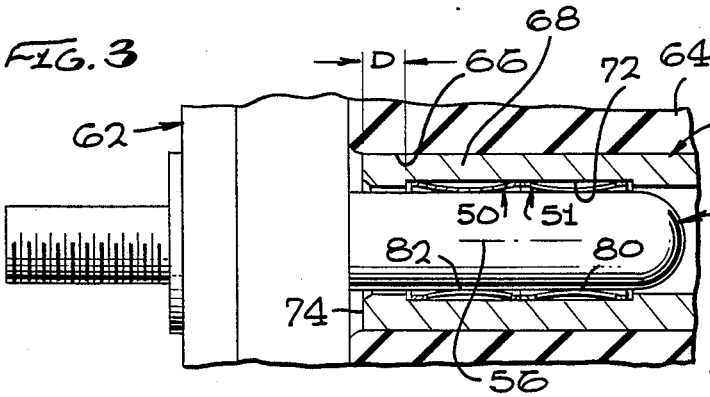
FIG. 3 is a partially sectional view showing a pin and socket of FIG. 2 in a fully mated condition.

FIGS. 3 illustrates one part 62 of the connection system showing one of the pins 31 and a corresponding one of the sockets 41. The pin assembly includes a dielectric housing 64 with a socket-holding aperture 66 therein which receives the socket 41. The socket includes a shell 68 having a substantially cylindrical hole 70, and having an internal groove 72 in the walls of the hole, starting at a location spaced a distance D from the outer end 74 of the shell. Two identical contactors 50, 51 lie in the groove. As will be discussed below, the contactors and shell are formed to provide a high interference fit between the pin 31 and the beams 58 of th contactors, with the contactor beams being resistant to deflection. This produces a high friction between the pin and contactors which assures that a high withdrawal force is required to unmate the connector parts. The free length of the pin 31, which is the length that is free to enter the socket as shown in FIG. 3, is great enough for the pin to make firm contact with the beams 58 of both contactors 50, 51.

The high friction between the pin and contactors results in the need for a workman to apply large forces, with some of the force possibly being applied in a direction that tends to tilt the pin with respect to the socket axis 56. The two contactors 50, 51 which are arranged in tandem along the socket, provide two groups of contact points 80, 82 where the pin is firmly contacted, with these contact points being spaced along the depth of the socket hole. The two contact points help to maintain the pin in alignment with the axis 56 of the hole and contactors, despite forces tending to tilt the pin, which assures the application of largely predictable frictional forces at the beginning of unmating. Once the pin begins to withdraw from the socket, the frictional forces are changed from static to the lower sliding friction, and withdrawal proceeds rapidly.

Figure 5:
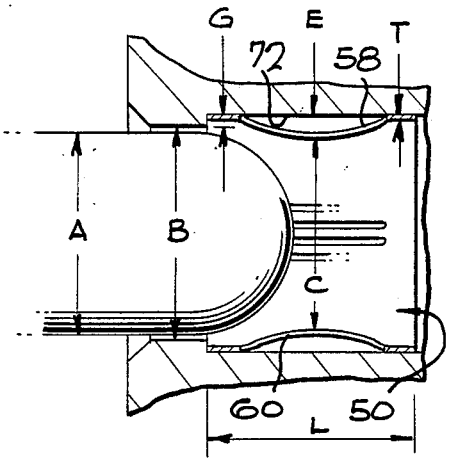
FIG. 5 is an enlarged view of a portion of the system of FIG. 3, with the pin not yet engaged with a contactor of the socket assembly.

In order to achieve high withdrawal forces, the thickness T (FIG. 5) of the contactor is made large so the beams 58 resist bending, and the depth G of the groove which holds the contactor is made shallow. The diameter A of the pin should be close to the diameter B of the socket aperture, although some looseness in fit is desirable to allow the pin to be inserted even with small nicks thereon. The levelof friction which the contactor 50 can apply to the pin is high only if there is a considerable difference between the outside diameter A of the pin and the inside diameter C of an imaginary circle on which the middle 60 of the contactor beams lie. If the differences or interference is great, then insertion of a pin will deflect the beam so far that they will be deflected past their elastic limit and will undergo some permanent or plastic deformation. Applicant uses thick contactors with the beams 58 inwardly bowed by a considerable distance E which usually causes some plastic deformation. This assures that even if the outside diameter of the pin is a minimum within the range of allowed tolerances, while the inside diameter C of the beams is a maximum within the allowed tolerances, the beams will be deflected at least close to their elastic limit to provide maximum resistance to withdrawal of the pin. Applicant finds that the forces required to insert and withdraw the pins from the socket is initially high, but with repeated insertions and withdrawals, the force decreases to a substantially constant level.

In a connection system constructed by applicant, the large pins such as 31 had an outside diameter of 435 mils (one mil equals one thousandth inch) while the socket hole had a diameter of 450 mils. Each contactor 50 was of stainless steel and had a thickness T of 9 mils, a length L of 470 mils, and an initial beam bowing E of 45 mils. Each contactor had thirty beams, each of a width of about 25 mils and a length of 320 mils. The contactors were formed from a metal sheet and curved as shown in FIG. 4, with a gap at 83 which is closed when the contactor is installed in the socket grooves. The depth G of the socket groove was 24 mils. The interference of the pin and contactor beams was therefore about 40 mils. The force required to withdraw a connection system of the type shown in FIG. 2, wherein almost all the withdrawal resistance was supplied by the four large pins 31–34, was initially 125 pounds. The withdrawal force continually decreased with repeated insertions and withdrawals, and had decreased to about 80 pounds after about fifty insertions and withdrawals. The withdrawal force remained about constant thereafter. As discussed earlier, a withdrawal force of about 80 pounds is desirable to assure that the connection system will remain connected despite the weight of perhaps of 15 pounds of cable tending to pull out the socket assembly. A force of 80 pounds can be readily applied by most workmen to pull out the socket assembly when necessary. Despite the high withdrawal force, low wear is achieved because each beam can ride over any nicks or other irregularities in a pin.

Thus, the invention provides a connection system which includes a socket for making low resistance contact with a pin inserted therein, which assures that a high mechanical resistance to withdrawal of a pin from the socket will be maintained while minimizing wear of the parts. This is accomplished by use of a pair of multibeam contactors lying in tandem in an internal groove of the socket. The contactors provide numerous points of contact with the pin, at two circles of contact spaced along th axis of the socket, to help guide the pin during insertion and withdrawal. The contactors are made thick enough and their beams are inwardly bowed sufficiently that they initially undergo plastic deformation when the pin is inserted. This assures attainment of high resistance to withdrawal of the pin, while providing a substantially consistant withdrawal force after numerous insertions and withdrawals of the pin.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. In an aviation electrical system wherein a group of sockets at the outer end of a heavy electrical cable can be mated with a corresponding group of pins on an aircraft, the improvement wherein:

at least one of said sockets includes a hole with a hole axis and with an outer end for receiving a pin, said socket having an internal groove in said hole which is spaced rearward of the forward end of the hole, and at least one contactor in said groove wherein the contactor includes a pair of substantially circular bands spaced apart in a direction parallel to said hole axis and a plurality of beams joining said bands with each beam inwardly bowed so the center of the beams lie substantially on an imaginary circle when not engaged with a pin;

one of said pins which corresponds with said one socket has a diameter smaller than that of said hole, but sufficiently larger than said imaginary circle to deflect said contactor beams at least partially plastically to permanently deform said beams when the pin is initially plugged into said one socket.

2. The improvement described in claim 1 wherein:

said at least one contactor includes two substantially identical contactors lying in tandem in said groove.

3. A method for establishing an aircraft contact system of a type wherein a heavy power cable has an outer end portion with a plurality of sockets which can be pushed around a plurality of corresponding pins on an aircraft and wherein the plurality of sockets resists withdrawal sufficiently to support the weight of the cable outer end portion, comprising:

establishing each of a group of sockets so each includes a substantially cylindrical hole, each hole having a groove which holds a contactor of the type that has a pair of spaced substantially circular bands connected by a plurality of radially inwardly bowed beams, with the centers of the beams lying on the surface of an imaginary cylinder of smaller diameter than a corresponding pin to provide an interference fit between the beams and pins;

said step of establishing including providing a large enough interference betweeen said pin and beam centers that said beams are plastically deformed;

inserting and withdrawing said pins from said group of sockets, to reduce the force required to withdraw the pins from the sockets until the withdrawal force drops to a substantially constant level;

thereafter using said sockets at the end of a cable to contact pins on an aircraft at an airport.

4. A socket assembly which can receive and electrically connect to a substantially cylindrical pin contact of predetermined diameter and length, comprising:

a primarily dielectric housing which has a socket-holding aperture;

a socket lying in said aperture and having an outer end, said socket having a largely cylindrical hole extending into said outer end and having an internal groove in said hole, said groove being spaced from said outer end;

a pair of multi-beam contactors lying in tandem in said internal groove, each contactor including a pair of opposite bands and a plurality of beams extending between said bands, said beams being bowed radially inwardly so the inside diameter of each of the contactors lying in the groove is less than the inside diameter of said cylindrical hole forward of said groove;

said pair of contactors including a first contactor closest to said socket outer end and a second contactor lying on a side of said first contactor which is furthest from said socket outer end;

the interference between said pin and contactors being sufficient that said contactors undergo plastic deformation when said pin is first inserted said hole, whereby to enable high interference to achieve high resistance to pin withdrawal.

5. An electrical connection assembly, comprising:

a housing which includes a socket having an outer end, said socket having a largely cylindrical hole extending into said outer end and having an internal groove in said hole, said groove being spaced from said outer end;

a pair of multi-beam contactors lying in tandem in said internal groove, each contactor including a pair of opposite bands and a plurality of beams extending between said bands, said beams being bowed radially inwardly so the inside diameter of each of the contactors lying in the groove is less than the inside diameter of said hole outward of said groove;

said pair of contactors including a first contactor closest to said socket outer end and a second contactor lying on a side of said first contactor which is furthest from said socket outer end;

a pin having a diameter greater than the inside diameter of said contactors to enter said contactors and deflect said beams to make firm contact therewith, said pin havbing a free length sufficient to pass through said outer end of said socket hole and enter both said first and second contactors and deflect their beams to make firm contact therewith.

6. An electrical connection assembly, comprising:

a socket having an outer end and a largely cylindrical hole extending into said outer end, said hole having an internal groove which is spaced from said outer end;

means lying in said groove and forming first and second pluralities of electrically conductive beams that are bowed radically inwardly, the beams of said first plurality of beams lying a first distance from said hole outer end and said second plurality of beams lying on a side of said first plurality of beams which is furthest from said hole outer end;

a pin which extends from said outer end of said hole deeply enough into said hoole and having a sufficient diameter to firmly contact both said first and second pluralities of beams.

7. The assembly described in claim 6 including:

first and second separate contactors respectively forming said first and second pluralitites of beams, each contactor having a pair of opposite bands and the beams of each contactor extend between the opposite bands of the contactor.

* * * * *